United States Patent [19]

Ebbeson

[11] 4,416,617

[45] Nov. 22, 1983

[54] APPARATUS FOR BURNING SPIRIT OR SIMILAR LIQUID FUELS

[75] Inventor: Bengt E. O. Ebbeson, Halmstad, Sweden

[73] Assignee: Origoverken I Halmstad Aktiebolag, Halmstad, Sweden

[21] Appl. No.: 197,108

[22] PCT Filed: Sep. 26, 1979

[86] PCT No.: PCT/SE79/00195

§ 371 Date: Sep. 26, 1980

§ 102(e) Date: Sep. 26, 1980

[87] PCT Pub. No.: WO80/01602

PCT Pub. Date: Aug. 7, 1980

[30] Foreign Application Priority Data

Jan. 29, 1979 [SE] Sweden ..... 7900744

[51] Int. Cl.[3] ..... F23D 3/40

[52] U.S. Cl. ..... 431/326; 431/152; 431/337; 431/344; 126/43; 126/44

[58] Field of Search ..... 431/142, 143, 197, 201, 431/326, 337, 344, 351, 152, 334; 126/250, 260, 43, 44; 239/145, 418

[56] References Cited

U.S. PATENT DOCUMENTS

| | | | |
|---|---|---|---|
| 241,125 | 5/1881 | Donald | 431/337 X |
| 466,867 | 1/1892 | Wojidkow | 431/326 |
| 599,147 | 2/1898 | Manning et al. | 431/326 |
| 1,036,523 | 8/1912 | Lange | 431/152 X |
| 1,130,501 | 3/1915 | Erichsen | 431/152 X |
| 2,609,041 | 9/1952 | Laramy | 158/91 |
| 3,316,957 | 5/1967 | Stockli et al. | 431/152 X |
| 3,606,609 | 9/1971 | Lipper et al. | 431/152 |
| 3,620,660 | 11/1971 | Laurent | 431/344 X |

*Primary Examiner*—Samuel Scott
*Assistant Examiner*—Randall L. Green
*Attorney, Agent, or Firm*—Berman, Aisenberg & Platt

[57] ABSTRACT

Apparatus for burning spirit or similar liquid fuels.

A draught or burner tube (16) has a flange (18) defining a gap (32) in relation to a ring spaced below the flange and supported thereby. The container is engaged with the ring from below, an exposed surface of a fuel-absorbing mass (28) being located inside the ring. A gap is open at the periphery of the flange and the ring so that combustion air is drawn to the draught or burner tube through the gap along the exposed surface of the mass together with fuel vapors evaporating therefrom.

8 Claims, 3 Drawing Figures

APPARATUS FOR BURNING SPIRIT OR SIMILAR LIQUID FUELS

The invention relates to an apparatus for burning spirit or similar liquid fuels, comprising a fuel container which is filled with a mass absorbing the fuel and having a completely or partly exposed surface from which the fuel evaporates, and a draught or burner tube projecting from the container and provided with a gap for the intake of combustion air between the tube and the absorbing mass.

Apparatuses of this kind are already disclosed in Swedish patent specifications Nos. 223,021 and 331,333, wherein the draught or burner tube forms an upward extension of a passage arranged in the absorbing mass and having a completely or partly exposed surface. According to the patent specification No. 223,021, the draught or burner tube is arranged in a fixed position in relation to the fuel container and the control of the flame is performed by means of a manually adjustable valve at the lower end of the passage arranged in the absorbing mass. According to the patent specification No. 331,333, the draught or burner tube is dimensioned and located in relation to the passage in the absorbing mass in such a way that an annular gap for the intake of combustion air is formed between the tube and the passage, the control of the flame being possible by changing the axial position of the draught or burner tube in relation to the passage in the absorbing mass.

In another embodiment shown and described in the British patent specification No. 1,249,165 the burner tube is arranged centrally in a top cover of the container, and valve-controlled ,apertures are arranged in the top cover around the burner tube for the intake of combustion air through the top cover above the exposed surface of the absorbing mass.

The purpose of the invention is to provide an apparatus of the kind initially referred to which provides an improved evaporation of the fuel and reduced wind sensitivity, which altogether provides an improved efficiency.

It is a further object of the invention to provide an apparatus having a more reliable functioning due to a reduced risk of soot generation, elimination of the possibility of removing the fuel container before the flame is completely extinguished, and reduction of the inconveniences associated with over-boiling when the apparatus is being used.

Finally, it is an object of the invention to provide a simpler construction of the apparatus and particularly the fuel container included therein, a continuous control of the flame in a simple manner at the same time being obtained by means of a manually adjustable control member provided on the apparatus.

The related objects are achieved by an apparatus of the kind initially referred to having obtained the characteristics according to claim 1.

Figure 1:
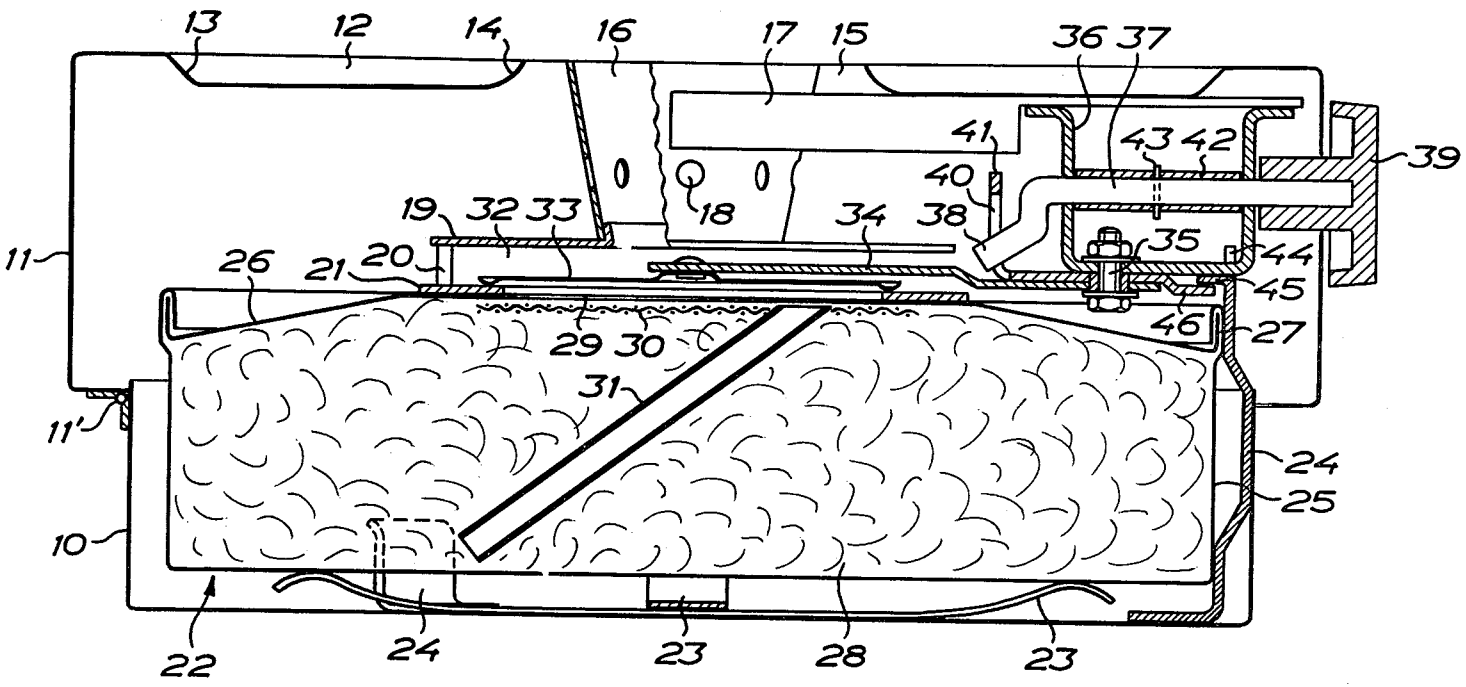
Figure 2:
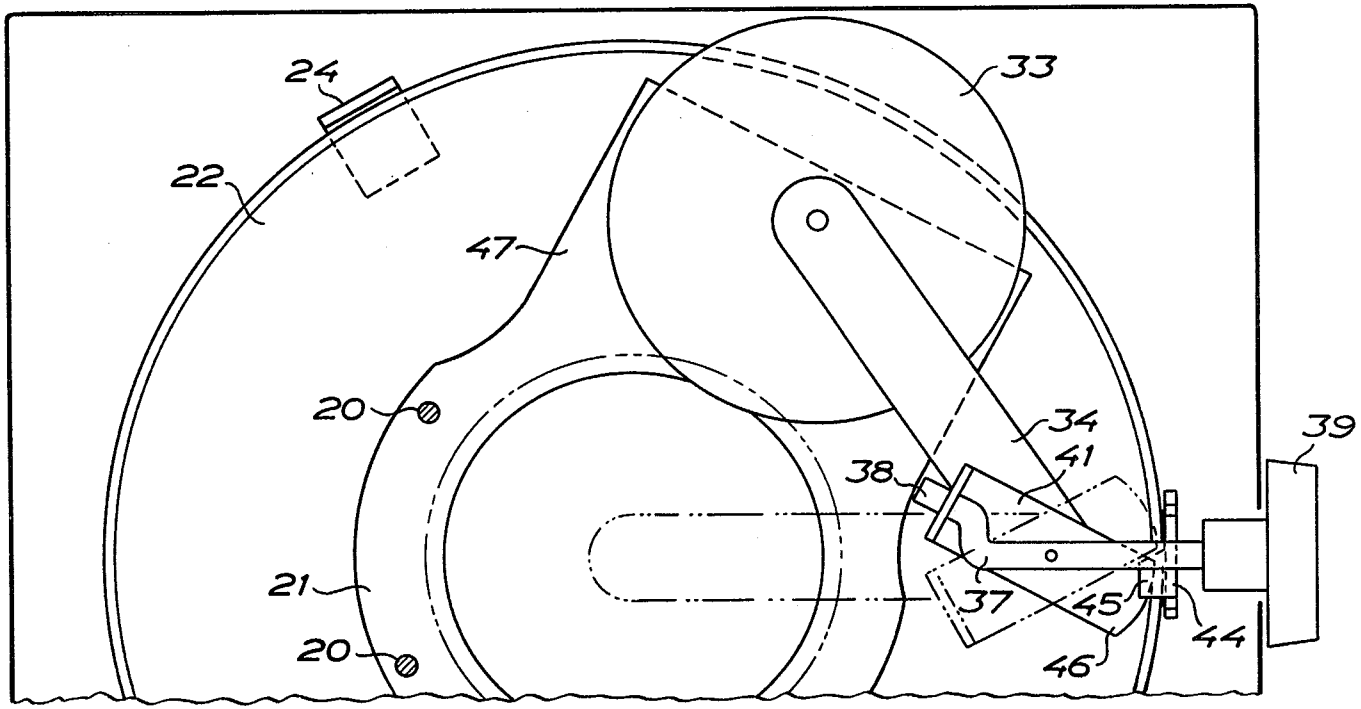
Figure 3:
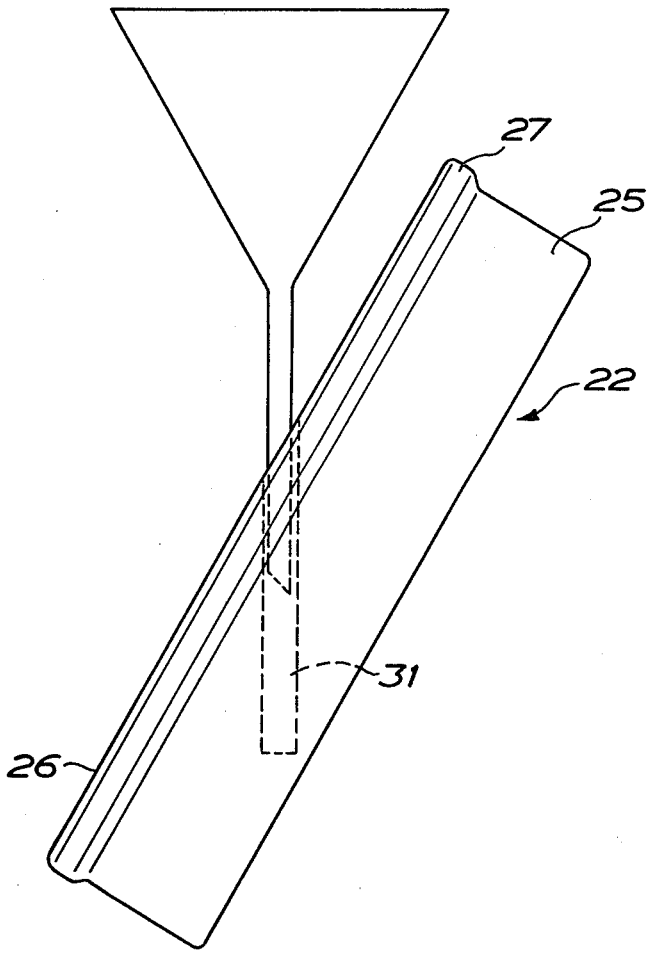

In order to illustrate the invention an embodiment thereof will be described in more detail below, reference being made to the accompanying drawings in which FIG. 1 is a cross-sectional view of the apparatus according to the invention with the lid in closed position, FIG. 2 is a fragmentary plan view of the apparatus, the lid and parts connected therewith being removed, and FIG. 3 is a side view of the fuel container when fuel being filled therein.

The apparatus shown in the drawings for burning spirit or similar liquid fuels is primarily intended as spirit stove for cooking, particularly in boats. The apparatus comprises a rectangular box 10 having a lid 11 which is pivotally connected to the box 10 at the left edge in a hinge 11' to be swung between a closed position according to FIG. 1 and a raised or opened position. The lid is formed in a conventional way with a circular annular depression 12 defined by a circumferential outer sloping shoulder 13 and a central inner flanged overflow edge 14 surrounding a central circular aperture 15 in the lid 11. Thus, between the shoulder 13 and the overflow edge 14 there is defined an annular tray formed by the depression 12 for receiving overflow at over-boiling. On the lid 11 there can be provided in a conventional manner a stand for supporting the cooking utensils.

A draught or burner tube 16 is arranged substantially coaxially in the aperture 15, said tube being supported by the lid in a fixed position by means of a number of arms 17 which can be spot-welded to the lid and the tube. The tube 16 has the form of a truncated cone with the large end upwards and the small end downwards, and a ring of circular perforations 18 are provided in the tube wall. An outwardly directed circular collar 19 is connected to the lower small end of the tube, which projects substantially horizontally from the tube, and a circular ring 21 is supported by the collar over spacers 20, the ring being spaced below the collar and being substantially parallel thereto.

A fuel container 22 is supported by crossing leaf springs 23 on the bottom of the box, the container being guided laterally by means of upwardly projecting standards 24, e.g. three standards connected to the bottom. The container comprises a can-formed lower part 25 and a top cover 26 which is attached to the lower part at a rim 27 projecting upwardly from the fuel container. Inside the fuel container there is an absorbing mass 28, such as mineral wool, for the absorption of the liquid fuel to be burnt in the apparatus. A circular aperture 29 is provided in the lid 26 of the fuel container, and the abosrbing mass 28 is exposed in said aperture over a substantially flat surface, said surface being covered by a grid or netting 30 which retains the mass 28 in the container so that it cannot penetrate from the aperture 29. The netting 30 extends under the top cover 26 to be positioned thereby. In the mass there is provided in a known manner a passage 31 opening into the aperture 29, for filling fuel into the container in the manner illustrated in FIG. 3. The netting 30 has of course an opening corresponding to the passage 31 in order that the passage shall be accessible for filling.

In the closed position of the lid 11 of the apparatus the ring 21 engages the upper side of the container 22 maintaining the container partly depressed against the bias of the springs 23. By this arrangement there is always a predetermined distance fixed between the flange 19 and the surface of the absorbing mass 28 exposed in the aperture 29, and as will be understood this distance is determined by the length of the spacers 20. Between the flange 19 and the substantially flat exposed surface of the absorbing mass 28 in the aperture 29 there is thus a gap 32 of a predetermined size, and the passage through the tube 16 communicates with the surrounding air at the periphery of the flange 19 through this gap. The fuel vapours escaping from the absorbing mass 28 when ignited will burn with a flame through the tube 16; the combustion air is drawn through the gap 32 and sweeps along the exposed surface of the absorbing mass 28 carrying with it the combustible fuel vapours therefrom.

The burner tube 16 may be cylindrical but a conical tube is preferred, because a lower structural height and improved efficiency are obtained thereby. The reduced diameter of the burner tube at the lower end thereof results in the air drawn through the gap 32 sweeping along the exposed surface of the absorbing material 28 in the aperture 29, which provides an improved evaporation of the fuel. Secondary air is supplied through the perforations 18 and as a consequence thereof the flame will spread upwardly, which provides a further improved efficiency. It has been found that the cooking utensil can be located at a smaller distance from the burner tube than in other similar apparatuses, which provides reduced wind sensitivity.

For extinguishing and controlling the flame in the draught or burner tube 16 there is provided a circular metal plate 33 which is sufficiently large to cover the aperture of the ring 21. The plate 33 is supported by an arm 34 at one end thereof, the other end of the arm being mounted to be pivoted on a subtantially vertical shaft on a U-formed bracket 36 attached to the lower side of the lid 11. By pivoting the arm 34 on the shaft 35 the plate 33 accordingly can be moved into and out of the gap 32 to cover completely or partly the aperture of the ring 21 and accordingly the aperture 29. In order to prevent the plate from getting caught on the edge of the ring the plate preferably is formed with a beaded edge. Preferably, the ring 21 forms an extension 47 providing a support for the plate when pivoted outwards.

A shaft 37 is rotatably mounted in the bracket 36 for pivoting the arm 34, said shaft having an angled crank 38 at the inner end thereof, which is located below the lid 11, and being provided with a knob 39 at the other end thereof located outside the lid laterally thereof. The knob extends with clearance through an opening in the lid. The crank 38 engages a slot 40 in an angular bracket 41 attached to the upper side of the arm 34, and a socket 42 is connected to the shaft between the legs of the bracket by means of a cross pin 43 to position the shaft 37 axially in the bracket 36. As will be realized, the arm 34 will be pivoted on the shaft 35 over the crank 38 engaging the slot 40, by rotation of the shaft 37. The angled crank 38 eliminates play in the control mechanism as compared with a right-angle crank.

As will be seen in FIG. 2, the angular bracket 41 is arranged obliquely in relation to the arm 34, which makes room for the plate 33 and provides the possibility to arrange the knob 39 exactly in register with the burner tube 16, the crank 38 being rotated symmetrically towards both sides for pivoting the plate between completely closed and open positions.

It is a safety requirement that the lid 11 cannot be raised from the box 10 for removal of the fuel container 22 before the flame has been extinguished, i.e. before the plate 33 has been moved into the gap 32 to the position thereof in which it covers the aperture 29 completely. In order to meet this requirement one of the standards 34 adjacent to the side wall of the box 10 is extended to the edge of the box and is formed there with a notch 44 opening at the top for receiving the bracket 36. A flap 45 is bent from the standard and the bracket can engage this flap when the lid is closed. The notch can widen towards the top thereof in order to guide the bracket into the notch. Since the draught and burner tube 16 and the control mechanism associated therewith including the plate 33 is suported by the lid, these elements of the apparatus will move together with the lid 11 when this is swung up and down. The angular bracket 41 has a projecting end portion 46 arranged such that this end portion clears the flap 45 only when the arm 32 is in the position wherein the plate 33 covers the aperture of the ring 21 and accordingly will completely cover the aperture 29 in the fuel container 22 when the lid 11 is closed. When the plate 33 is moved from this position by the knob 39 being operated and the arm 34 being pivoted as a consequence thereof the end portion 46 will be moved to a position below the flap 45 and accordingly it will not be possible to open the lid 11 because the end portion and the flap lock the lid 11 to the box 10. When the plate 33 is again brought to the position thereof wherein it covers completely the aperture of the ring 21 the end portion 46 of the angular bracket 41 will again clear the flap 45 such that the lid can be raised. The relatively rigid standard 24 provides stability and precision to the lock mechanism.

It is clear from the description above that the container 22 is of a relatively simple construction and that the entire control and cut-off mechanism is supported by the lid 11 and is well protected below the lid. If over-boiling takes place the overflow will be collected in the tray 12, but it can of course happen that the overflow is so large that this tray will be overfull. In that case the overflow will continue through the aperture 15 and then will be collected on top of the cover 26 of the fuel container 22 where it will be retained by the projecting rim 27 which thus functions as an overflow rim. There is no risk of failure of the control mechanism due to overflow, because the mechanism is well protected.

Preferably, the ring 21 is made of steel such that it will not be worn by the plate 33 sliding thereon. Due to the fact that the plate is fixedly connected to the collar 19 and the gap 32 thus is independent of the container 22 proper there is always provided one and the same gap and also an excellent precision of the control. A further advantage is that the container can be made of aluminium which is a light and cheap material well-suited for the manufacture of the container. Finally, the ring provides some isolating effect such that the burner will not "run away" due to a too heavy heating of the container and thus a more rapid evaporation of the fuel when the apparatus is being used continuously for an extended time.

A depression can be arranged in the absorbing mass 28 in the opening 26 in order to make the apparatus less sensitive to flame blow-out.

I claim:

1. Apparatus for burning spirit, or a similar liquid fuel, comprising a container means for containing said fuel and absorbing means for absorbing said fuel, said container means having a surface for exposing said absorbing means, a burner tube located above said container means and physically separate therefrom, a flange means extending outwardly from a lower edge of said burner tube, a ring secured to said flange means and spaced from said flange means to form a gap for the intake of combustion air between said tube and said absorbing means, said ring having an aperture adapted to be aligned with said surface of said container, a plate for covering said aperture, mounted for pivotal movement between said ring and said flange, elastic biasing means for urging said container means against said ring to align said surface and said aperture, and wherein the burner tube (16) is a truncated cone with the smaller end below the larger end.

2. Apparatus for burning spirit, or a similar liquid fuel, comprising a container means for containing said fuel and absorbing means for absorbing said fuel, said container means having a surface for exposing said absorbing means, a burner tube located above said container means and physically separate therefrom, a flange means extending outwardly from a lower edge of said burner tube, a ring secured to said flange means and spaced from said flange means to form a gap for the intake of combustion air between said tube and said absorbing means, said ring having an aperture adapted to be aligned with said surface of said container, a plate for covering said aperture, mounted for pivotal movement between said ring and said flange, elastic biasing means for urging said container means against said ring to align said surface and said aperture, and wherein the burner tube (16) is fixed to a lid (11) which is pivotally mounted on a box (10) for receiving the fuel container (22).

3. Apparatus according to claim 2, wherein the burner tube (16) is fixed to a lid (11) which is pivotally mounted on a box (10) for receiving the fuel container (22).

4. Apparatus according to claim 3, wherein the fuel container (22) is supported in said box on said biasing means.

5. Apparatus according to claim 3, wherein said plate (32) is supported by an arm (34) pivotally mounted to the lid (11), which can be operated by a member (39) arranged on the outside of the lid.

6. Apparatus according to claim 5, wherein the ring (21) has an extension (47) to support the plate (33) when the major part of the ring aperture is uncovered.

7. Apparatus according to claim 5, wherein the arm (34) is arranged to engage an abutment (46) in the box for preventing rotation of said lid with respect to said box (10), for each position of the arm (34) wherein the plate (32) is completely or partly displaced from the position wherein the plate covers the aperture of the ring (21).

8. Apparatus for burning spirit, or a similar liquid fuel, comprising a container means for containing said fuel and absorbing means for absorbing said fuel, said container means having a surface for exposing said absorbing means, a burner tube located above said container means, flange means extending outwardly from a lower edge of said burner tube, a ring secured to said flange means and spaced from said flange means to form a gap for the intake of combustion air between said tube and said absorbing means, said ring having an aperture adapted to be aligned with said surface of said container, said burner tube, flange means, and ring forming a unit physically separate from said container means, a plate for covering said aperture, mounted for pivotal movement between said ring and said flange, and elastic biasing means separate from said container means and said ring for urging said container means against said ring to align said surface and said aperture.

* * * * *